United States Patent [19]

Kelly et al.

[11] 4,343,255

[45] Aug. 10, 1982

[54] AUTOMATED PLACKET SHIRT MACHINE

[75] Inventors: James C. Kelly; Frederick W. Garnett, both of Starkville, Miss.

[73] Assignee: Starkville Tool and Die Company, Starkville, Miss.

[21] Appl. No.: 34,917

[22] Filed: May 1, 1979

[51] Int. Cl.[3] ..... D05B 1/00; D05B 33/00; D05B 21/00

[52] U.S. Cl. ..... 112/262.3; 112/121.29; 112/121.12; 112/130; 112/275

[58] Field of Search ..... 112/262.3, 262.1, 121.11, 112/121.12, 121.15, 121.29, 2, 130, 239, 275

[56] References Cited

U.S. PATENT DOCUMENTS

| | | | |
|---|---|---|---|
| 2,944,496 | 7/1960 | Gardner | 112/65 |
| 3,070,049 | 12/1962 | Kalning | 112/121.29 X |
| 3,349,732 | 10/1967 | Perrella et al. | 112/65 |
| 3,500,780 | 3/1970 | Emus et al. | 112/121.29 |
| 3,704,884 | 12/1972 | Nicolay et al. | 112/121.29 X |
| 3,788,248 | 1/1974 | Marforio | 112/121.29 |
| 3,871,307 | 3/1975 | Scott et al. | 112/121.15 |
| 4,067,272 | 1/1978 | Marforio | 112/121.29 |
| 4,069,778 | 1/1978 | Kozawa | 112/121.12 |
| 4,227,470 | 10/1980 | Mitchell et al. | 112/121.12 |

OTHER PUBLICATIONS

"The Ajax T Stacker", p. 22 of *The Needles Eye* pub. by Union Special Machine Co., 8/1963.

*Primary Examiner*—H. Hampton Hunter

*Attorney, Agent, or Firm*—Breneman, Kane & Georges

[57] ABSTRACT

An automatic placket shirt front forming machine and method for sewing placket shirt fronts is provided which utilizes an apparatus and method to automatically position, sew, mitre cut and remove a sewn placket shirt front and stack the placket shirt front. The method and apparatus requires the operator to only master the task of properly layering the material which may be facilitated by utilizing a set of guides. Once the material is layered and aligned, the operator has only to activate a start or reset button to clamp, transfer and position the placket shirt front and automatically start the sequential operation of sewing and mitre cutting, thread cutting and stacking of the finished placket shirt front. The method of the present invention forms placket shirt fronts by initiating the sewing of the placket shirt from the bottom of the placket shirt opening and sewing outwardly to the top or neck portion of the shirt resulting in the application of the invention to chain stitch, lock stitch and a variety of other types of sewing machines. The present apparatus includes means for incrementally advancing the placket shirt front as the sewing machine slits and sews the garment and thereafter automatically positions the garment for the mitre cut and automatically removes and stacks the shirt.

32 Claims, 14 Drawing Figures

FIG.11
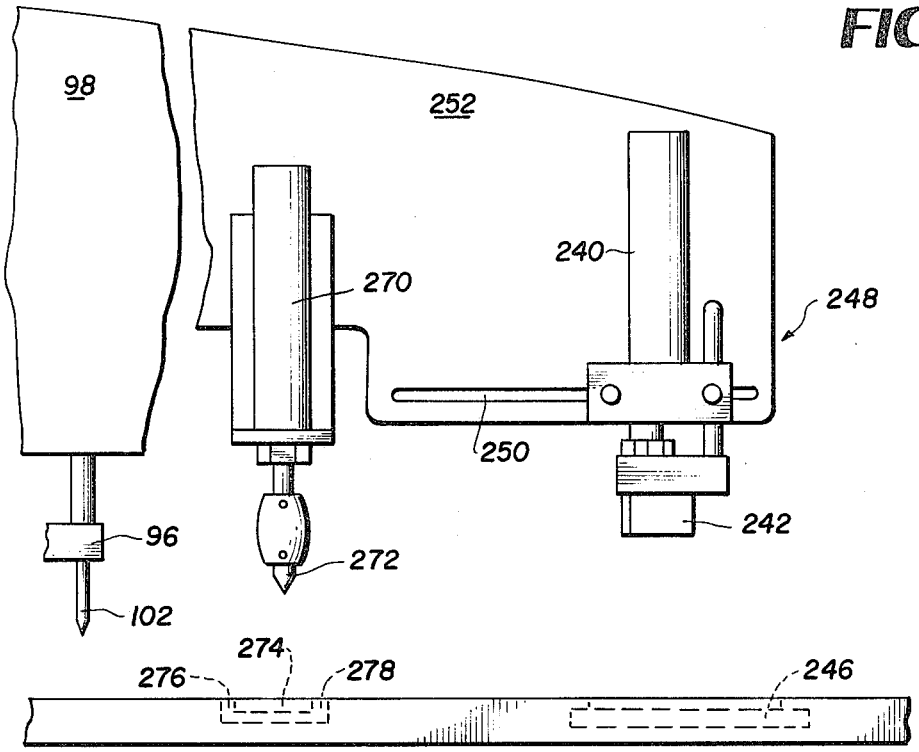
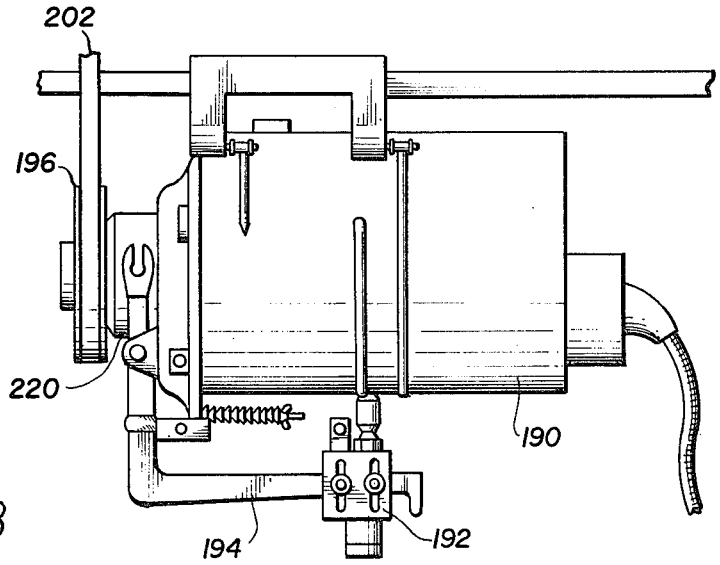
FIG.8

AUTOMATED PLACKET SHIRT MACHINE

BACKGROUND OF THE INVENTION

1. Field of the Invention

The present invention relates to an automated placket shirt front forming machine and method for sewing placket shirts applicable to chain stitch, lock stitch and other types of sewing machines to provide a completely automatic apparatus and method which allows the machine operator to sew placket shirt fronts without having to master the art of sewing. More particularly, the present invention pertains to apparatus and method which requires the operator only to properly line up the placket shirt front, the placket and liner before activating the machine which then automatically completes all sewing, mitre and thread cutting and stacking of the finished placket shirt front.

The apparatus includes means for clamping and transferring the properly aligned parts to a means for sewing and slitting the placket shirt front, means for mitre cutting, thread cutting and stacking finished placket shirt fronts. The method of the invention includes the automatic sewing, mitring and stacking of placket shirt fronts by initiating the sewing of the placket shirt front, placket and liner intermediate the ends of the placket shirt front and sewing to one end of the placket shirt front.

The present method and apparatus of the invention provides for the automatic positioning of the material under the sewing machine and automatically sewing and incrementally advancing the placket shirt front maintained by the sew clamp through the sewing machine in coordination with the movement of the needle and slitting operation from a point intermediate the ends of the placket shirt front to one end of the placket shirt front. The invention provides an inexpensively formed placket shirt front that reduces labor and waste of placket shirt material components while increasing the precision and quality of the finished garment.

2. Description of the Prior Art

The prior art includes a variety of patents pertaining to semi-automatic sewing machines for sewing or providing assistance in the formation of garments such as placket shirt fronts. It is well recognized in the prior art and the placket shirt industry that the formation of placket shirt fronts involves considerable time, labor and skill of the placket sewing machine operator in not only positioning the placket shirt front, placket and liner but also in maintaining the position of the components during sewing so that the seams are straight and the placket shirt front when turned is not crooked, puckered or otherwise of an unacceptable quality. It is also recognized by those skilled in the art that formation of placket shirt fronts having buttoned fronts are generally even more difficult to produce as the tolerances in properly laying out and sewing the components of placket shirt are more demanding. For example, if stitching on either side of the placket or the slitting is not exact, the placket shirts formed may have a non-aligned front producing a "seconds" quality shirt. The skill of the sewing machine operator has heretofore been extremely important in lining up and sewing up the placket from the top or neck portion of the shirt down to the center or chest portion of the shirt. The traditional method of sewing placket and improvements in the prior art method of sewing placket shirts type shirts from the neck down has been the subject of various patents.

One such patent, Scott U.S. Pat. No. 3,871,307 pertains to a placket forming machine which employs a chain stitch sewing machine and provides a fabric workpiece clamp which is employed to clamp the garment and thereafter advance along a track at a regulated speed employing a hydraulic cylinder to advance the garment and clamp in the sewing operation. After completion of the sewing machine, a pair of knives are automatically engaged to pick up the stitch forming threads and to sever the threads. After the threads are severed, the clamp returns to the start position.

The operation of the chain stitch machine in Scott et al, U.S. Pat. No. 3,871,307 at best provides a semi-automated placket forming machine that requires considerable attention of the sewing machine operator and does not position, mitre, remove, or sew placket shirt fronts utilizing either the apparatus or method of the present invention to form the placket shirt front and also stack the finished product. In U.S. Pat. No. 3,871,307 the clamp assists the placket machine operator by guiding the aligned placket shirt parts through the machine. The apparatus and method disclosed in U.S. Pat. No. 3,871,307 is materially different than provided by the present invention since in the prior art patent the operator still begins sewing of the placket shirt and thereafter sews downward from the neck to the center of the shirt. Thereafter a chain stitch cutting apparatus engages the thread and cuts the thread so that the placket shirt front may thereafter be removed by the operator.

The operation of the placket shirt forming machine as described in U.S. Pat. No. 3,871,307 requires the operator to still operate the machine in coordination with the guidance of the placket clamp and necessitates the mitre cutting and stacking of the placket shirt front before beginning work on the formation of a second placket shirt which similarly requires the operator to line up the shirt front, placket and liner.

The present invention by way of contrast is not limited to any particular type of sewing machine and is completely automatic in that it only requires the operator to layer the garment materials. Once the materials are properly layered, the apparatus of the present invention automatically positions the garment under a sew clamp which then positions the garment under the sewing machine, sews, mitre cuts, cuts sewing threads and stacks the shirt front without further attention or skill of the operator. The fully automatic process of the invention is aided by a novel method in which the traditional method of sewing placket shirts starting from the neck of the shirt and sewing down to the center of the placket shirt is replaced by a method in which the placket shirt is sewn starting from the center portion of the shirt up to the neck or top of the shirt while the machine is slitting the liner, placket and shirt front. The method of the present invention allows the construction of a fully automated placket shirt forming machine that is not subject to the disadvantages and limitations in prior art placket sewing machines.

In Dorosz, U.S. Pat. No. 3,814,038 a sewing machine is provided having a pallet for supporting a workpiece for movement relative to the tool. The pallet is mounted on a moving means that is synchronized for movement with respect to the operation of the sewing machine needles. U.S. Pat. No. 3,814,038 does not pertain to placket forming machines. Dorosz does not suggest or contemplate the utilization of the present combination of elements and new and useful result provided by the transfer clamp, sew clamp and the mitring, cutting, and stacking operation of the finished product that is achieved by the present invention. Furthermore, the provision for the timed motion of the pallet utilizes apparatus that is entirely different from the present invention as the timed motion for the movement of the rack and pinion in relation to the penetration of the needle utilizes a nipple and eccentric cam arrangement.

The present invention unlike the prior art begins the sewing of the placket shirt front, placket and liner by initiating the slitting and sewing of the placket shirt front at a point at the lowest point of the placket shirt and thereafter sewing up to the top or neck position of the placket shirt thereby eliminating much of the labor, attention and skill heretofore required of sewing machine operators to not only increase productivity but also the accuracy and quality of the placket shirt fronts sewn in accordance with the method and apparatus of the present invention.

As a result of the method and apparatus the present invention provides an enormous economic advantage in the production of high quality placket shirt fronts without having to rely upon the skill of the placket sewing machine operator. One of the distinguishing features of the present invention is the utilization of a transfer clamp and sew clamp to increase productivity and to initiate the sewing operation of the placket shirt from the center or mid portion of the placket to the top or the neck portion of the shirt to provide a method and apparatus for increasing not only productivity and accuracy of the placket sewn shirt but also assist in the cutting, mitring and removal of the placket shirt front and the subsequent stacking of the finished placket shirt fronts.

SUMMARY OF THE INVENTION

The disadvantages and limitations of prior art apparatus and methods for automating sewing machines and placket shirt front forming machines is obviated by the present invention which provides a fully automated, placket shirt front sewing machine and method of sewing placket shirt fronts that eliminates the labor and skill heretofore required in the formation of the placket shirt front and increases accuracy and productivity. The method and apparatus of the invention employs a high speed-type operation capable of producing about six shirts a minute or over 360 placket shirt fronts per hour if the operator could layer the components at least as fast as the present machine can sew, mitre and stack the finished product. In experimental operations of machines constructed in accordance with the invention well over 1,800 placket shirt fronts per day were produced and required only the attention of the automated placket sewing machine operator in layering and lining up the placket shirt front, placket and liner and thereafter starting the machine.

Apparatus constructed in accordance with the broadest aspects of the invention automatically engages garments and guides them to a sewing machine which initiates the sewing of the garment at a point intermediate the ends of the garment and sews from that point to one of the ends of the garment. In the preferred embodiment of the invention a transfer clamp is utilized to guide a properly layered garment to a sew clamp which automatically clamps the layered placket shirt front components and positions the components under the sewing machine thereafter activating the sewing machine to slit and sew the components together.

Upon completion of the sewing and slitting of the placket shirt components the machine automatically mitres, cuts the thread and stacks the finished placket shirt front while the operator of the apparatus is free to properly layer and line up a second placket shirt front, placket and liner so that upon completion of the stacking operation the sew clamp returns to automatically engage the placket shirt components and transfer them to the sew clamp of the placket machine for subsequent sewing and stacking.

The advantages incumbent in the present apparatus for forming placket shirt fronts stem in part from the method of sewing placket shirts which initiates the sewing operation at a point corresponding to the fullest length of the placket shirt opening and sews from that point, which is generally about the chest portion of the shirt, up to the top or neck portion of the placket shirt. Placket shirt fronts sewn in accordance with the invention not only assist in reducing "seconds" quality shirts but also increases the accuracy of shirts produced while providing means for readily and mechanically removing the placket shirt front from the placket sewing machine without requiring the attention and time of the placket shirt sewing machine operator to remove the garment from the machine.

The placket machine operator is consequently free to again line up the components while the machine is sewing, mitring and stacking the previous garment. In the preferred embodiment two guides are employed to assist the operator in properly lining up the placket shirt components of placket shirt front, placket and placket liner. The first guide device may conveniently consist of a marked positioning area or index on the placket machine work table to assist in the positioning and centering of the placket shirt front with the placket and liner.

A second guide for assisting in the positioning of the layers of the garment may be provided in the form of a light having a cross hair shining on the work table surface or other positioning means to assure the proper lining up of the components of the placket shirt front. In this embodiment all that is required is the lining up of the neck of the placket shirt body with the first guide means and thereafter lining the placket with the neck of the placket shirt body and the second guide means. Thereafter the liner is aligned with the neck of the placket shirt body and the second guide means to assure that the placket shirt front, placket and liner will be slit, sewn and properly mitred by the automated placket sewing machine of the present invention.

The activation of the present apparatus requires only that the operator depress the placket sewing machine start button to thereafter result in the placket machine automatically sewing the placket shirt without further attention of the placket machine operator. It will be recognized the advantages of this system allows the operator's attention to be directed to aligning an additional placket shirt front, placket and liner without having to divert attention to the operation of the sewing machine, stacker or any other aspect of the sewing of the placket shirt front and thereby increases production by at least 600 shirts per day over current production methods since the completion of the cycle takes about sixteen hundreths of a minute from the time they are slit, sewn, mitred and stacked at the back end of the machine.

The activation of the start button activates a transfer clamp which moves from a rest position to a position above the layered placket shirt components, at which time a second switch is activated causing the transfer clamp to clamp the layered garment composed of the placket shirt liner, placket and placket shirt front. The transfer clamp upon clamping the components activates a further switch which transports the clamped layers of cloth from the work area portion of the machine to the sew clamp by the activation of a transfer clamp cylinder which positions the layers of cloth underneath the sew clamp. As soon as the transfer clamp has positioned the layered garment under the sew clamp a further switch is activated resulting in the disengagement of the transfer clamp and its movement to a rest position which is a position intermediate the sew clamp and work area where the operator may be stacking a further shirt front, placket and liner.

The movement of the transfer clamp to the rest position activates a switch causing the sew clamp to drop down and positively clamp the placket shirt front, placket and liner which in turn initiates the travel of the sew clamp toward the foot of the sewing machine which as a result of the configuration of the sew clamp allows slitting of the garment prior to the initiation of the sewing operation. Preferably, one or more air jets are employed to blow the layered material past the foot of the sewing machine to assist in the positioning of the garment under the foot of the sewing machine prior to the lowering of the modified sewing machine foot and activation of the sewing machine. It will be recognized that the function of the transfer clamp and sew clamp may be combined so that the transfer clamp and sew clamp may be effectively combined into a single means for transferring a placket shirt front, placket and liner to the sewing machine.

Once the placket shirt front, placket and liner are positioned under the sewing machine and the foot of the sewing machine is lowered on the sew clamp over layered garment at a point corresponding to the center of the placket shirt front or the lowest part of the shirt from the neck at which the placket shirt front is designed to extend, the slitting and sewing is initiated. Once sewing is initiated, the movement of the sew clamp is thereafter advanced the length of a single stitch and only when the sewing needles are not engaged in the garment.

The advancement of the garment may be provided by for example a rack and pinion which may be driven by the hand wheel of the sewing machine by the connection of an eccentric arm to provide a one way ratcheting through an indexing clutch that preferably advances the rack for movement of the sew clamp in a timed relationship to the operation of the needles of the sewing machine. It will be recognized that at whatever the speed at which the sewing machine is operated will similarly control the speed of the sew clamp which is geared through the one way indexing clutch to ratchet the sew clamp through the sewing machine until the sewing machine has completed sewing the placket from a point intermediate the ends of the garment to one end of the garment.

In operation of the air clutch the rack and pinion mechanism is indexed to reach a predetermined position which corresponds to the neck portion of the shirt at which point the sewing machine stops. At this point a switch is activated which positions the sewing needles out of the cloth, actuates cylinder to lift the foot, and releases the thread tension and thereafter advances the sewclamp and sewn and slit garment to the proper position for the mitre cut. The mitre cutting cylinder is activated to automatically provide the mitre cut which may occur before or after but preferably after the shirt tail is clamped in the stacker unit.

After the mitre is cut the pressure on the sewing machine foot is released after the shirt is clamped the sew clamp is returned to the rest position to there after activate a cylinder connected to the raker bar which pulls the shirt and sewn layered parts from the sewing machine which places the threads in a taunt state for cutting. During the extension of the raker bar the threads are severed by a novel impact cutter. At the end of travel of the raker bar in the stacker unit the clamp is disengaged and the transfer clamp is free to move from its rest position to clamp a second shirt set up on the work table on the placket sewing machine if the start button of the machine has been again been activated by the operator signifying the completion of the task of layering the placket shirt front, placket and liner prior to the cycling of the machine.

It will be recognized that the present method and apparatus constructed in accordance therewith may be adapted to not only utilize a lock stitch machine as heretofore described, but also chain stitch machines and other forms of sewing machines. The method of sewing the placket shirt from a position at or near the center of the shirt to the top or the neck of the placket shirt allows the placket shirt to be more quickly and accurately sewn and removed from the shirt front machine. In contrast to the prior art it will be further recognized that the present placket sewing machine is completely automated with the attention of the operator being required only to stack the placket shirt front, placket and liner and engage the machine. Thereafter, the automatic placket sewing maching transfers, sews, cuts and stacks the final product at the back end of the machine.

Among the many advantages incumbent in the present invention is that the automated placket sewing machine of the present invention eliminates much of the time, skilled labor and error of prior art operations. Furthermore, the sewing of the placket from the center of the shirt to the top of the shirt eliminates many of the problems involved in the removal of the placket shirt front from the sewing machine and allows a wide variety of mechanisms to be utilized to perform the positioning, slitting, sewing, mitring and stacking of a finished placket shirt or other garment. Moreover, as a consequence of the design and construction of the invention, the present invention is far less expensive to operate and provides a more precisely formed placket shirt front at a higher rate of production than has heretofore been accomplished by prior art apparatus.

DESCRIPTION OF THE DRAWINGS

Other advantages of the invention will become apparent to those skilled in the art from the following detailed description of the invention in conjunction with the appended drawings in which:

FIG. 8 is a rear elevational view of the means for driving the placket forming machine of the present invention;

FIG. 11 is a partial side elevational view of the mitre, thread cutter and a portion of the sewing machine of the automated placket forming machine;

DETAILED DESCRIPTION OF THE INVENTION

Figure 1:
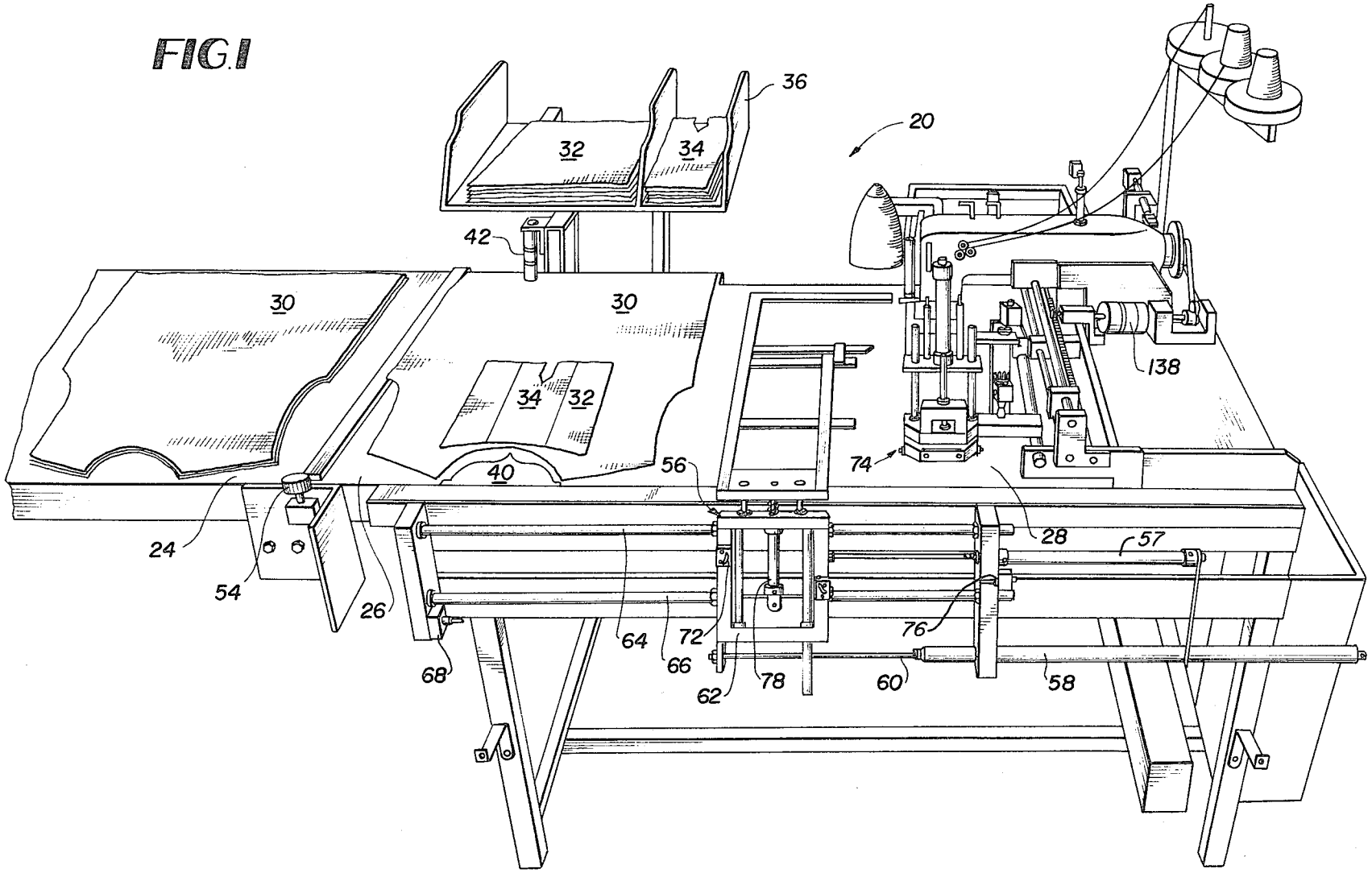
FIG. 1 is a perspective view of a placket shirt front forming machine constructed in accordance with the invention.
Figure 2:
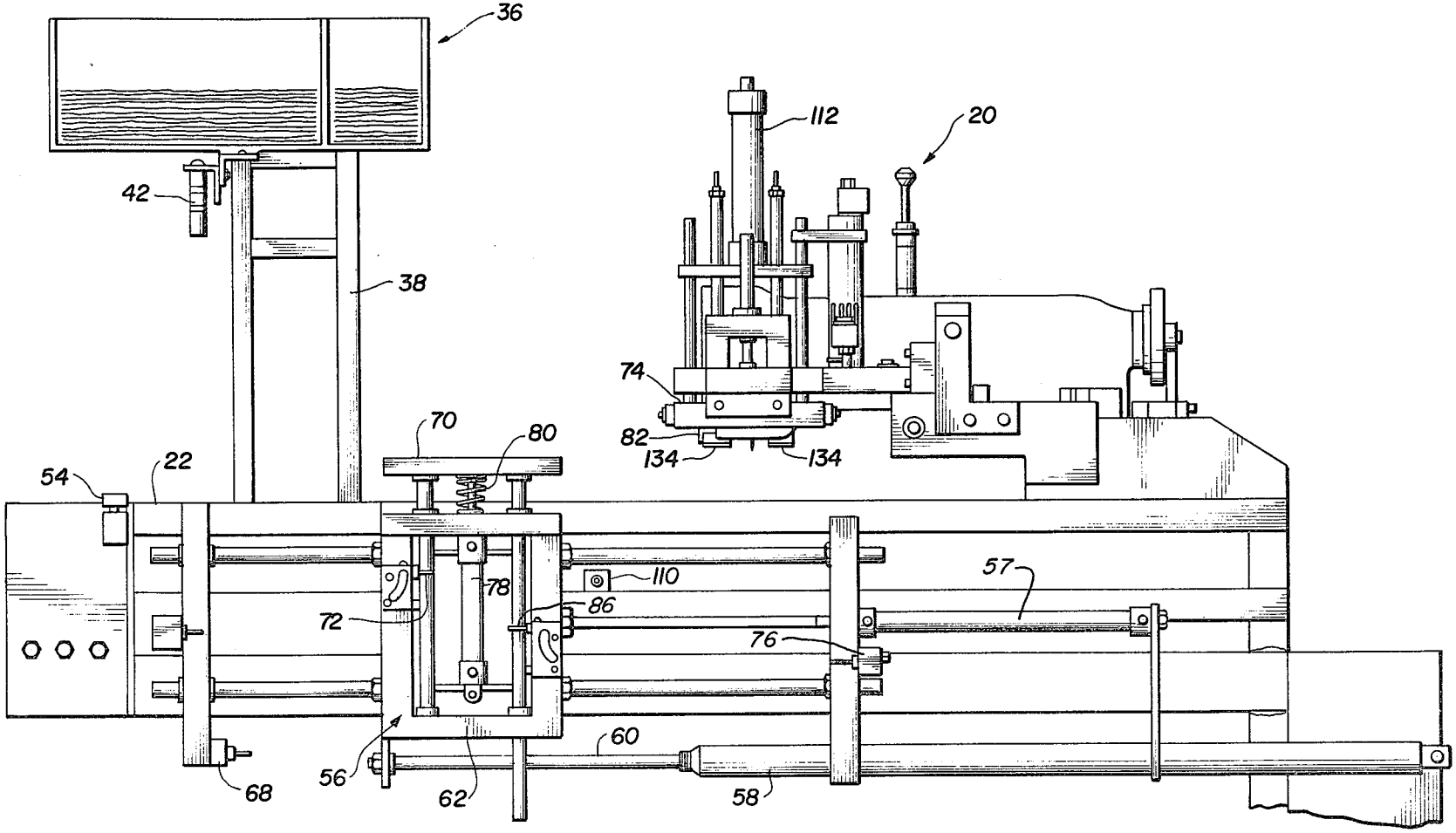
FIG. 2 is a front elevation view of a portion of a placket machine utilizing the present invention.
Figure 3:
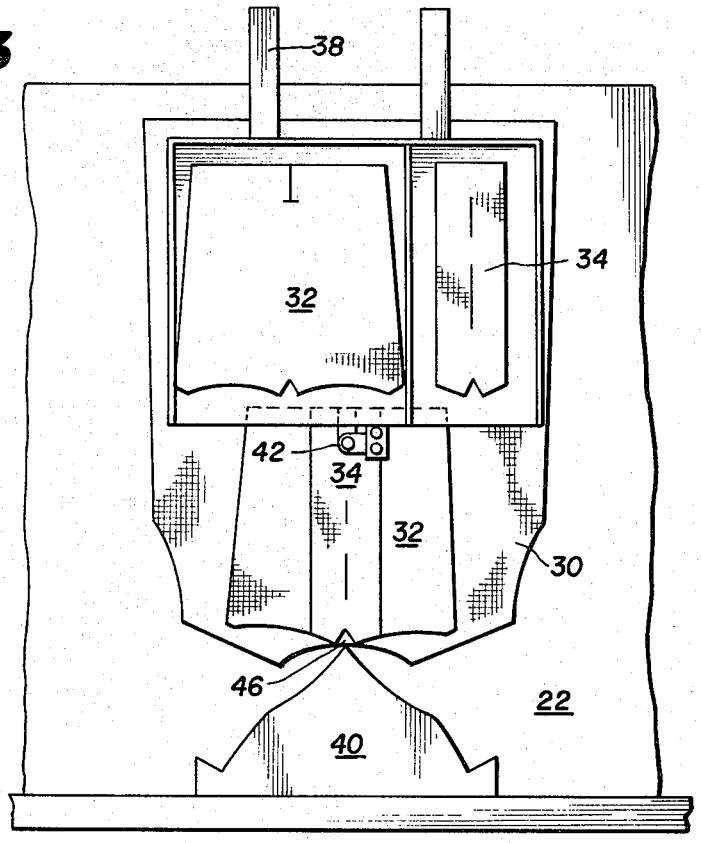
FIG. 3 is a top plan view illustrating a portion of the work table of the automated placket forming machine of the invention.

Referring now to FIGS. 1 and 2 a placket shirt forming machine 20 constructed in accordance with the invention is provided having a flat smooth table 22. Table 22 may be conveniently divided into areas 24, 26, and 28. Area 24 may be utilized for receiving placket shirt bodies 30 which can be layered in work area 26 along with placket 32 and liner 34 in a manner well known in the art. To facilitate production a work box 36 may be attached to a work table 22 utilizing a support structure 38, although it will be recognized that alternative configurations and utilization of the work area 26 and work box 36 are possible to suit particular requirements. Work area 26 may conveniently include a first alignment means such as marker 40 for centering and positioning the top or neck areas of body 30, placket 32 and liner 34 on work area 26.

Work box 36 provides a support for the attachment of a second alignment means such as positioning and alignment of placket shirt body 30, placket 32 and liner 34 on the work table 22. First guide means or marker 40 may be adjustable or include markings to accomodate the positioning of a variety of styles of placket shirt fronts. Second guide means 42 is preferably adjustable along with the travel of the sew clamp to accomodate variations in desired length of placket shirt front openings. Work table 22 is preferably smooth and provides little friction to the sliding of cloth across the surface from areas 26 to 28 for reasons that will become apparent.

With reference now to FIGS. 1, 2, 3, 4 and 5 it will be appreciated that the operator of the fully automated placket machine has only to properly layer placket shirt body 30, placket 32 and liner 34 in work area 26. To assist the operator in the proper alignment of the shirt body 30, placket 32, and liner 34 a first guide means 40 is provided in work area 26 of table 22. The operator thereafter aligns the placket 32 and liner 34 by utilizing the shirt body 30 and guide means 40 in conjunction with a second guide means 42 to assure the proper positioning of the garment on table 22 so that the automatic placket sewing machine of the invention may thereafter sew, mitre, cut and stack the sewn placket shirt front without requiring further labor or attention of the operator of the placket machine.

Figure 4:
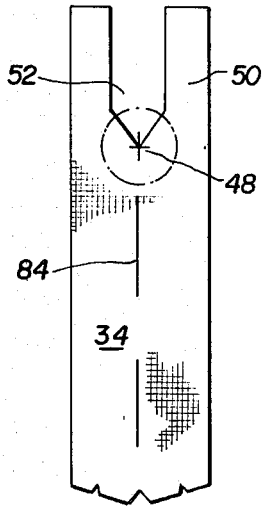
FIG. 4 is a top plan view of a liner illustrating a guide means provided in accordance with the invention.
Figure 5:
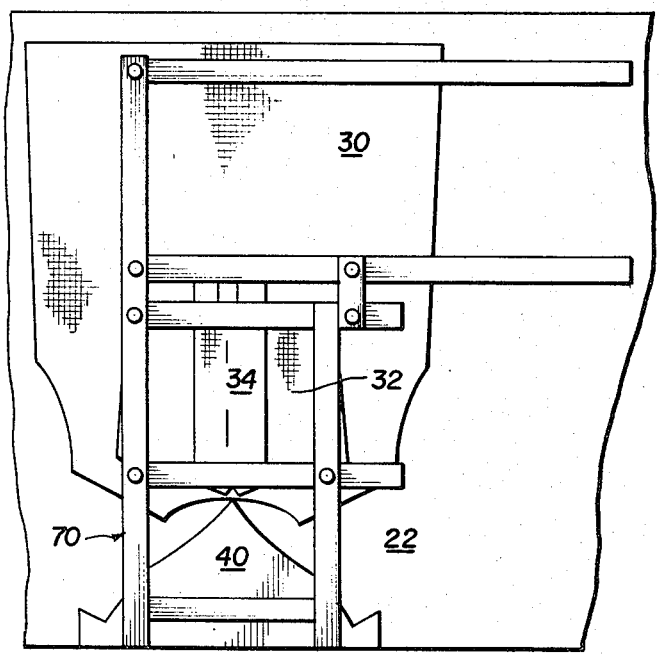
FIG. 5 is a top plan view illustrating the transfer clamp and placket aligning guide means.

In the alignment and layering of the garment the operator lines up the center of the neck portion 46 in alignment with the first guide means 40 and then takes a placket 32 and similarly aligns it with guide means 40 and the light provided by second guide means 42 so that the cross hair 48 (FIG. 4) is directed down to a T-shaped cut in the placket to assist in the alignment of the placket shirt parts in the manufacture of placket shirts. The operator then takes a liner 34 and similarly aligns it at the neck portion 46 on the placket 32 in alignment with the first guide means 40 and the second guide means 42 so that cross hair 48 is similarly in alignment with the notched out portion 52 of the bottom portion 50 of the liner 34 (FIG. 4).

Once the alignment and layering of the garment components is complete, the operator of the automatic placket sewing machine has only to depress start switch 54 to complete not only the placket sewing, but also the cutting, mitring and stacking of the finished placket shirt front. As is understood by those skilled in the art of placket shirt construction the proper positioning and maintenance of layers during the sewing operation is the most critical part in the process of making placket shirts. This aspect of the construction of placket shirt fronts is achieved with a great deal of precision in the present invention by the utilization of clamps to align and maintain the position of the layers of cloth in the fully automated operation of slitting, sewing, mitring and stacking of the garment. While the present automatic placket machine in the preferred embodiment utilizes air driven cylinders to actuate the various mechanical movements it will be understood by those skilled in the art that the present invention may be utilized by employing other fluid, electrical or other driving means.

Once switch 54 is depressed the operation of the automated placket forming machine is provided by the triggering of additional switches by the mechanical motion and timed inter-relationship of the functions of transferring the cloth to the sewing machine, slitting, sewing, mitring, cutting the threads and the ultimate stacking of the finished placket shirt front. In this manner, errors resulting from inadvertence, inattention or fatigue can be eliminated by the provision of the present completely automated placket shirt forming machine. Actuation of switch 54 results in transfer clamp assembly 56 moving from its rest position as illustrated in FIG. 1 to work area 26 on table 22 to a position above the layers of cloth forming the placket shirt front. Transfer clamp assembly 56 is positioned over the layered shirt front by the actuation of a transfer clamp cylinder 58 extending rod 60 which may be conveniently actuated by air pressure, hydraulic pressure or other fluid or electrical impulses. Lower frame 62 of transfer clamp assembly may be of a rectangular configuration which may travel on rails 64 and 66 designed to span work areas 26 and 28 of table 22. Upon completion of travel to a position above the placket shirt body lower frame 62 of transfer clamp assembly 56 contacts a switch 68 which causes the top portion 70 of transfer clamp assembly 56 to clamp down on placket shirt front 30, placket 32 and liner 34 which in clamping down (FIG. 5) results in the activation of switch 72.

Once switch 72 is activated rod 60 is retracted in cylinder 58 thereby transferring clamp assembly 56 and placket shirt body 30, placket 32 and liner 34 across the surface of table 22 to area 28 and position the transfer clamp assembly under sew clamp or sew clamp assembly 74. At the end of the travel of rod 60 switch 76 is closed which releases air pressure in both cylinder 58 and cylinder 78 which as a result of the action of spring 80 raises transfer clamp portion 70 to release the placket shirt body, placket and liner in the alignment position for subsequent clamping and sewing under sew clamp assembly 74. The release of pressure in cylinder 78 and the action of spring 80 lifts the top portion 70 of transfer clamp assembly 56 to clear the raised sew clamp assembly 74 and raised sewing machine foot assembly 82 and at the same time activates a further switch 86. The activation of switch 86 energizes cylinder 57 to result in the travel of transfer clamp assembly 56 back to its rest position as illustrated in FIG. 1.

A particularly advantageous aspect of the present invention is that transfer clamp assembly 56 places the placket shirt body, placket and liner directly under the sew clamp assembly 74 so that the center portion 84 (FIG. 4) of liner 34 which is layered over placket and shirt body and which may be partially pre-slit, is positioned directly under sew clamp assembly 74 so that the center slot 90 (FIG. 6) of sew clamp 74 is in direct alignment with the partially perforated center portion 84 of the liner 34 (FIG. 4). It will be recognized that center portion 84 of the liner which is layered over the placket and shirt body is in slot 90 of sew clamp 74 and is in direct alignment with slitter knife 94 also disposed on the sewing needle assembly 96 of sewing machine 98. As heretofore described the sewing machine employed is for the purposes of illustration a lock stitch machine made by one of the commercial manufacturers such as Singer but it will also be understood that the present invention is applicable to a variety of machines such as chain stitch and other types of sewing machines.

Figure 6:
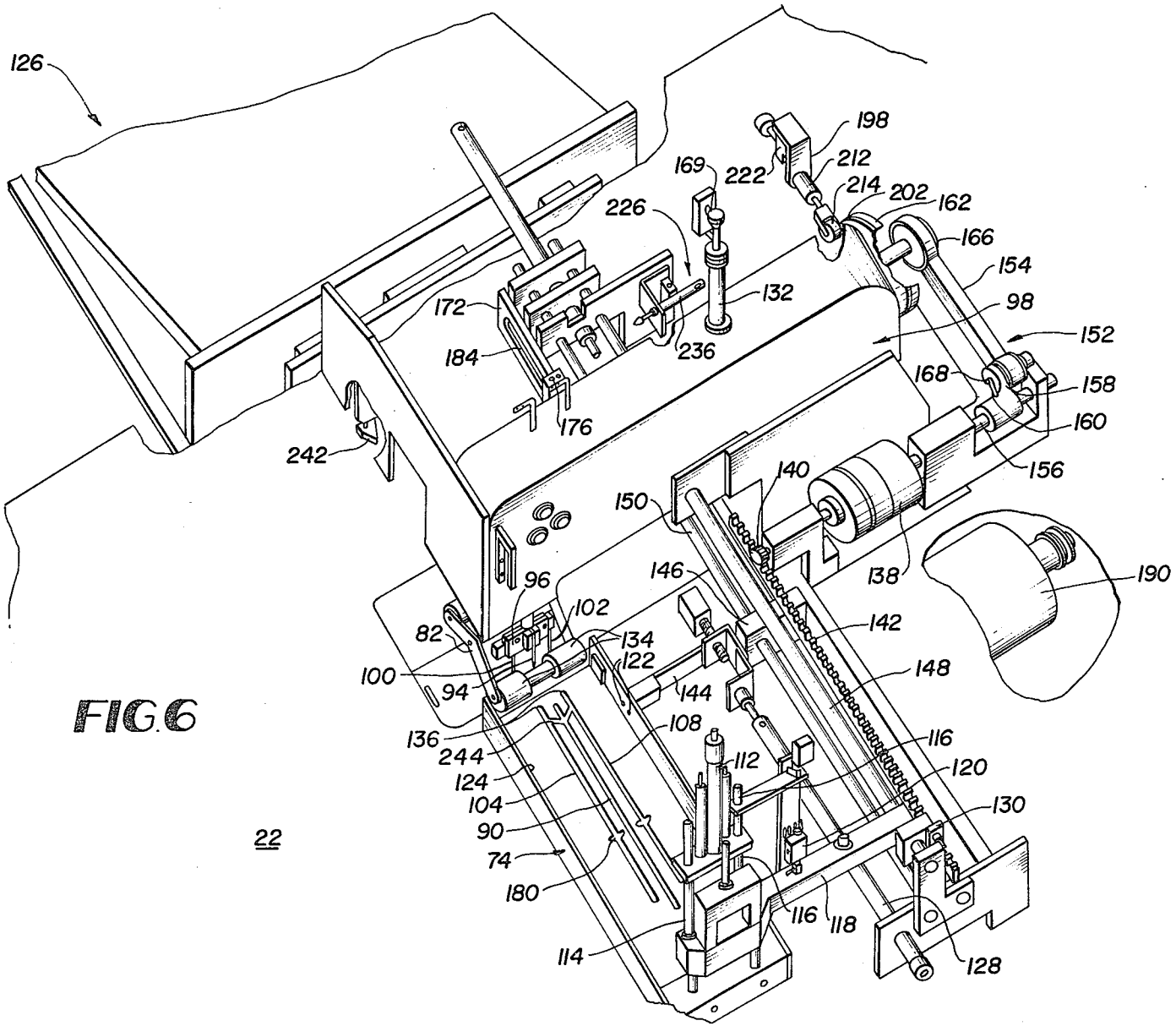
FIG. 6 is a perspective view of a portion of a placket forming machine of the present invention.
Figure 7:
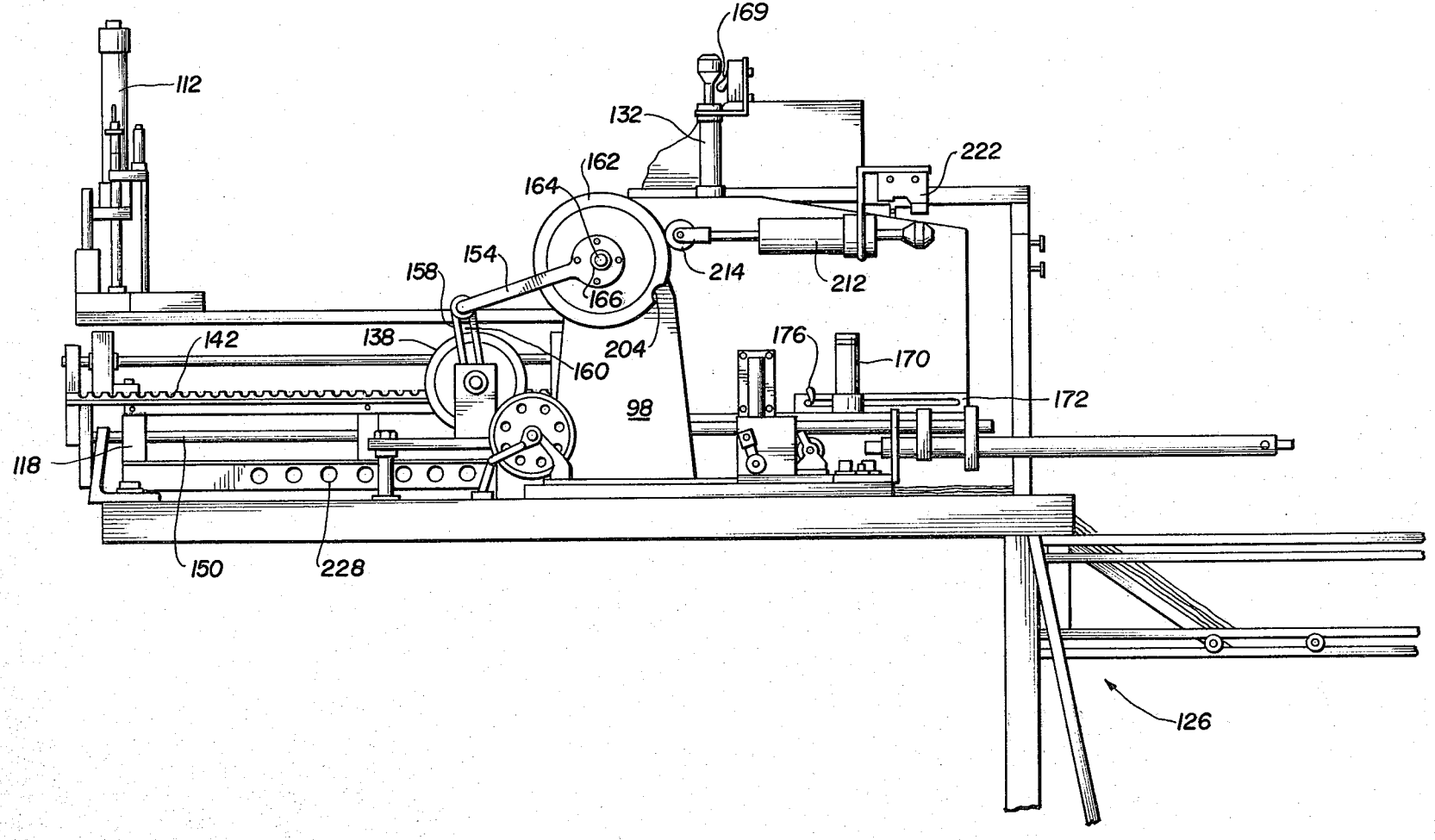
FIG. 7 is a side elevation view from the right side of a fully automated placket sewing machine in accordance with the invention.
Figure 9:
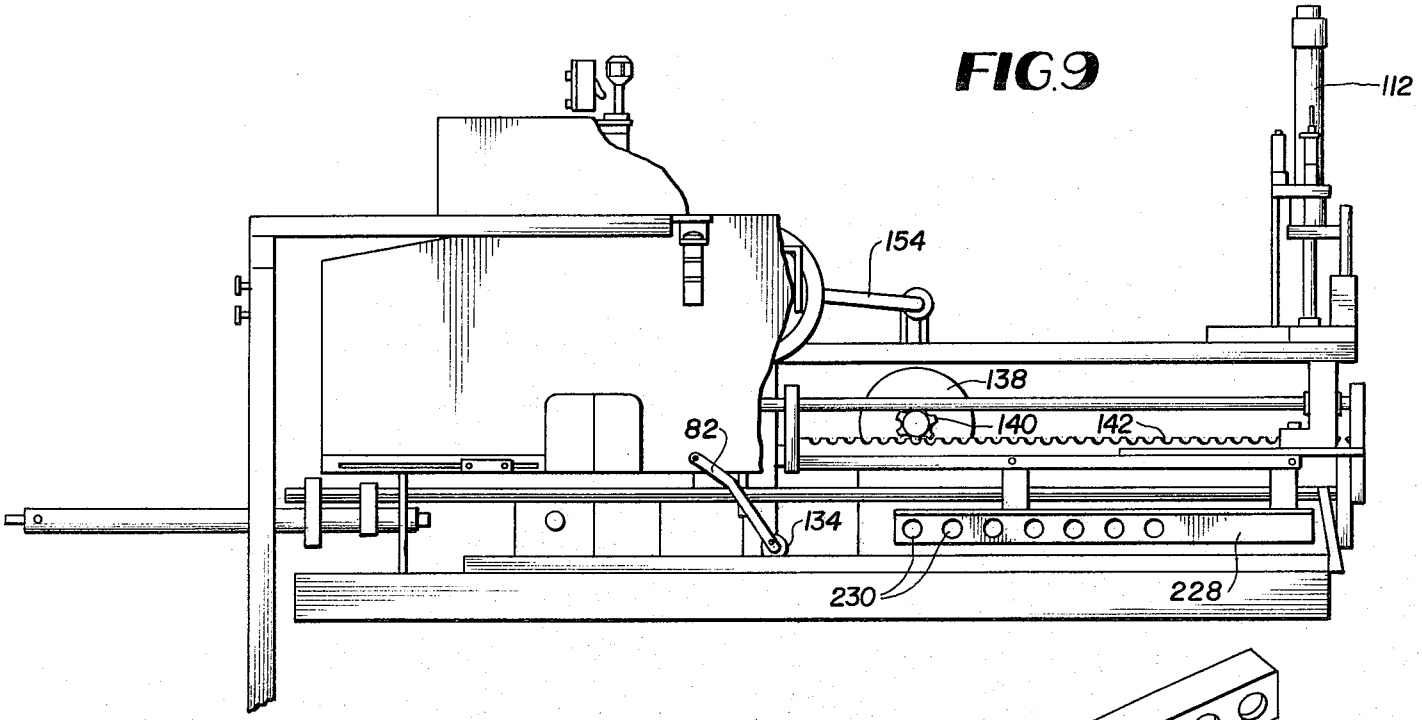
FIG. 9 is a portion of a left side elevation view of a portion of the placket forming machine in accordance with the present invention.
Figure 10:
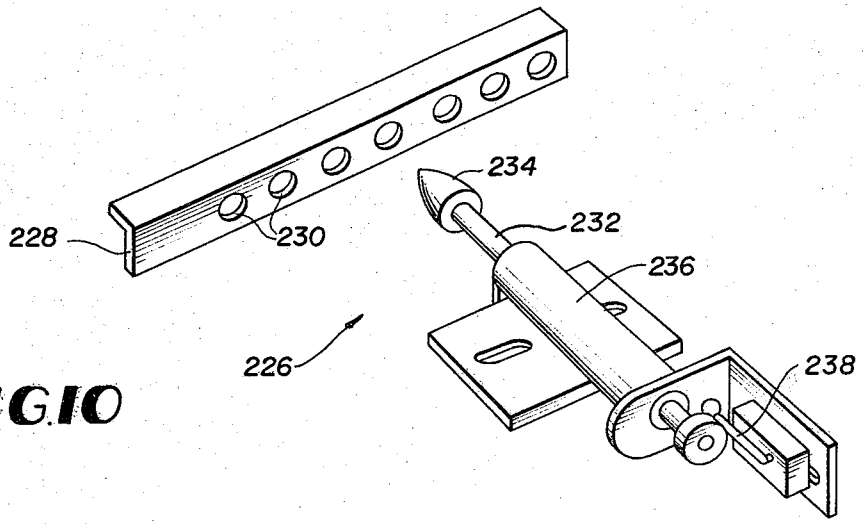
FIG. 10 is a perspective view of the mitre positioning engagement mechanism.
Figure 12:
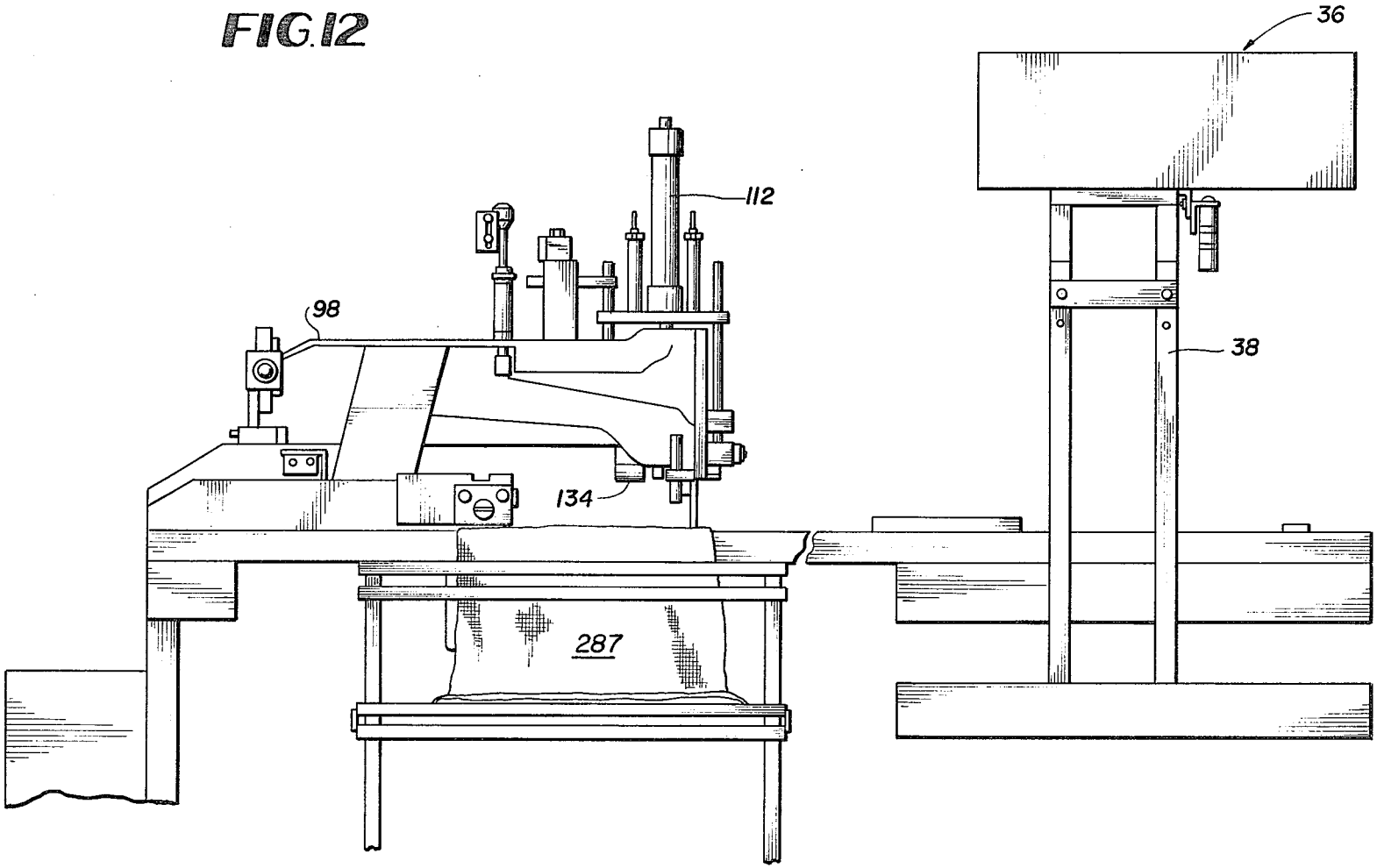
FIG. 12 is an elevational view from the rear of one form of the placket forming machine of the invention.

Needles 100 and 102 are in direct alignment with slots 104 and 108 of sew clamp assembly 74 so that upon actuation of sewing machine 98 the liner, placket and shirt body are automatically both slit and sewn during the operation of sewing machine 98. The method of the present invention along with the efficient sew clamp assembly 74 allows the cloth to be slit and sewn at about the same time during the operation of the sewing machine. As heretofore been described the activation of switch 86 results in the activation of cylinder 57 resulting in the return of transfer clamp assembly 56 to its rest position as illustrated in FIG. 1. Once transfer clamp assembly 56 has moved to the rest position, switch 110 is activated (FIG. 2) which activates cylinder 112 and causes the sew clamp assembly 74 to firmly clamp the placket shirt body, placket and liner. The clamp of sew clamp assembly 74 on the placket shirt body, placket and liner results in lowering of the sew clamp on guide rods 114 and 116 resulting in the activation of a switch 120 (FIG. 6).

Activation of switch 120 results in the activation of air jets 122 and 124 which are directed toward sewing machine 98 and assist in blowing the tail of the shirt out and under the sewing machine foot assembly 82. In this manner, the tail portion of shirt body 30 is guided toward the stacker unit 126 for subsequent slitting, sewing, mitring, thread cutting and stacking. Switch 120 also may activate sew clamp cylinder 128 to advance the sew clamp to the start sew position under sewing machine foot assembly 82. The advancement of the sew clamp assembly 74 by cylinder 128 to the start sew position, lines up the needles 100 and 102 and the slitter knife 94 with slots 104, 108 and 90 of the sew clamp assembly 74. Upon the advancement of sew clamp 74 to its start sew position under foot assembly 82 of sewing machine 98 a switch 130 is activated causing cylinder 132 to drop foot assembly 82 on top of sew clamp 74. Foot assembly may conveniently include four rollers 134 for rolling on the top of sew clamp assembly 74 which further assists in the operation of the slitter knife 94 so that slitting of the garment can occur either before or simultaneously with the sewing operation. It will be recognized that sewing of the placket shirt begins at the center or a point intermediate the ends of the garment such as at position 136 and sews from there to the top of the neck portion of the shirt to provide the advantages of the present invention.

The activation of switch 130 may also be utilized to activate air clutch 138 which may be a suitable air clutch model such as Horton model BW air clutch. Sew clamp assembly 74 which is supported by arm 118 is pushed to sew position by cylinder 128 and is associated with air clutch 138 through a pinion 140 which is associated with rack 142. Rack 142 is operatively connected to sew clamp 74 by supports 144 and 146 at one end and arm 118 at the other end which are adapted for slideable engagement on rods 148 and 150 and which when engaged at the start sew position is thereafter controlled by the action of air clutch 138 and the drive of rack 142 by pinion 140.

Activation of switch 130 can also result in starting the operation of sewing machine 98 which is connected to air clutch 138 by means of a cam assembly 152 which results in an incremental ratcheting of pinion 140 in rack 142 resulting in sew clamp assembly 74 being incrementally advanced in coordination with the length of the stitches sewn by needles 100 and 102 and the speed of the sewing machine in the advancement of the sew clamp 74.

Referring now to FIGS. 6, 7, 8, 9 and 10 the operation of sewing machine 98 in coordination with the advancement of sew clamp 74 will be briefly examined. Cam assembly 152 provides for the incremental advancement of sew clamp 74 by employing an arm 154 which is connected to air clutch 138 by a shaft 156 having a slotted arm member 158 having a slot 160 for adjustment of the cam assembly 152 which is attached to the sewing machine handwheel 162. Cam assembly 152 is eccentrically mounted to center shaft 164 of sewing machine handwheel 162 by a bearing assembly 166 of arm 154 so that once in every revolution rack 142 advances when needles 100 and 102 are withdrawn from the garment.

The function of slot 160 is to adjustably position a pin 168 in the slot so that upon each revolution of the sewing machine handwheel the rack 142 is advanced in accordance with the length of each stitch sewn by needles 100 and 102 of the sewing machine 98. The air clutch 138 and a one directional clutch, housed in the shaft area of arm 158 is utilized for incrementally advancing pinion 140 in rack 142. After dropping of sewing machine foot assembly 82 by cylinder 132 switch 130 or preferably a further switch 169 which causes the machine to begin sewing and advancing as pinion 140 incrementally advances along rack 142. The sewing, slitting and movement of the sew clamp 74 past the sewing machine 98 continues until the sewing machine and sew clamp 74 has advanced a predetermined distance which corresponds to the length of the placket shirt opening from the center of the shirt to the top or neck portion of the shirt.

The method of the present invention unlike prior art methods and apparatus for sewing placket shirts, starts at the center of the shirt and sews up to the top or neck portion of the shirt. The present method consequently is conveniently adaptable to chain stitch, lock stitch and other types of sewing machines to provide an easy method for removing the sewn, slit and mitred placket shirt front from sewing machine 98.

Indexing of the rack 142 and operation of the sewing machine continues until the machine has reached the end of travel. The length of travel of the rack 142 may be conveniently set by the positioning of a stop guage 170 in a slotted member 172 so that as soon as rack 142 has traveled the predetermined distance a switch 176 is contacted which corresponds to the predetermined point 180 on sew clamp assembly 74. This position may be conveniently altered by modifying the position of the stop guage 170 in slot 184 of slotted member 172. As soon as switch 176 is contacted sewing machine motor 190, located underneath the sewing machine 98 is stopped and air clutch 138 is deactivated so that pinion 140 is free to rotate and travel in rack 142.

Referring now to FIG. 8, the switches on sewing machine motor 190 are illustrated wherein a switch 192 is activated as soon as sewing machine motor 190 is deactivated to prevent further operation of the machine in the sewing operation. As soon as switch 192 is activated, the handwheel position locking assembly 198 is allowed to engage a notched out portion 204 in sewing machine handwheel 162. Handwheel 162 is connected to pulley 196 of the motor 190 via a belt 202 which assures the braking of sewing machine handwheel 162 as pressure is applied to cylinder 212 forcing a stop mechanism 214 into the corresponding notch or notched out portion 204 in handwheel 162.

In the preferred embodiment of the invention a small positioning motor illustrated as 220 on motor 190 may be employed to turn motor 190 slowly until stop mechanism 214 is locked into the notch 204 on sewing machine handwheel 162. Once stop mechanism is engaged in notch 204 on handwheel 162 the needles 100 and 102 along with slitter knife 94 are removed from the material. The activation of cylinder 212 and the locking of stop mechanism in notch 204 of handwheel 162 actuates switch 222 which extends cylinder 132 of foot assembly 82 of sewing machine 98 and thereby raises foot assembly from the sew clamp assembly 74 and the sewn placket shirt front, sewn placket liner and placket.

The activation of switch 222 may also be utilized to activate a mitre positioning cylinder 236 (FIGS. 6 and 10) which advances the sew clamp 74 to the mitring position for the mitre cut. Mitre positioning cylinder is associated with sew clamp by suitable means such as a pinion and rack assembly associated with sew clamp assembly 74. Sew clamp assembly includes a positioning bar 228 suitably attached to sew clamp 74. Positioning bar 228 which includes a series of holes 230 that are designed to be engaged by cylinder rod 232 having a cone shaped tip 234 to assist in the engagement of one of the predetermined holes 230 or bar 228. The advancement of tip 234 into one of the holes 230 is assisted by cylinder 236 which when extended activates a further switch 238.

Activation of the mitre positioning cylinder 236 in combination with the mitre positioning means 226 operates to precisely position the sewn placket shirt front for the mitre cut. As will be appreciated by those skilled in the art the engagement of one of the holes 230 by the activation of mitre positioning tip 234 is preset according to the length of the placket portion of the placket shirt and is a critical aspect in the manufacture of placket shirts. More particularly, the positioning of the mitre of the mitre cut must be within a few stitch lengths in order for the mitre cut to be properly oriented and positioned on the shirt to provide a quality placket shirt.

Once mitre positioning means 226 has locked sew clamp 74 into proper position for the mitre cut switch 238 is activated energizing cylinder 240 (FIG. 11) forcing a V-shaped mitre cutting blade 242 down through the placket shirt front cloth and through V-shaped opening 244 (FIG. 6) in sew clamp 74 and through shirt body 30 and into a corresponding nylon insert 246 in table 22 to result in the formation of the wedge shaped mitre cut in the sewn placket shirt front. Mitre cutter assembly 248 along with nylon insert 246 may be slideably mounted with respect to table 22 to allow the adjustment of the mitre to accomodate a variety of shirts. A slot 250 may be provided in member 252 which may be attached to sewing machine 98.

In addition to mitring the shirt, switch 238 may be employed to activate the stacker unit 126 (FIGS. 6, 7, 12, 13 and 14). Once the shirt has been advanced to the mitre cut portion the bottom portion of the placket shirt body 30 (FIGS. 7 and 14) is allowed to drop over the back end of table 22. Switch 238 may be utilized to clamp the bottom portion 254 of the shirt in a shirt clamp formed by a support 256 of a wedge shaped table 258 mounted on rollers 260 to ride in tracks 262 to allow the lateral movement with respect to a stationary bracket or bar 264. The activation of the clamp may be provided by a cylinder 266 (FIG. 14) or other available means to clamp support 256 against bracket 264. As will be discussed in greater detail a means is provided to maintain constant tension for the shirt clamp independent of the number of layers of shirts previously stacked on table 258.

Figure 13:
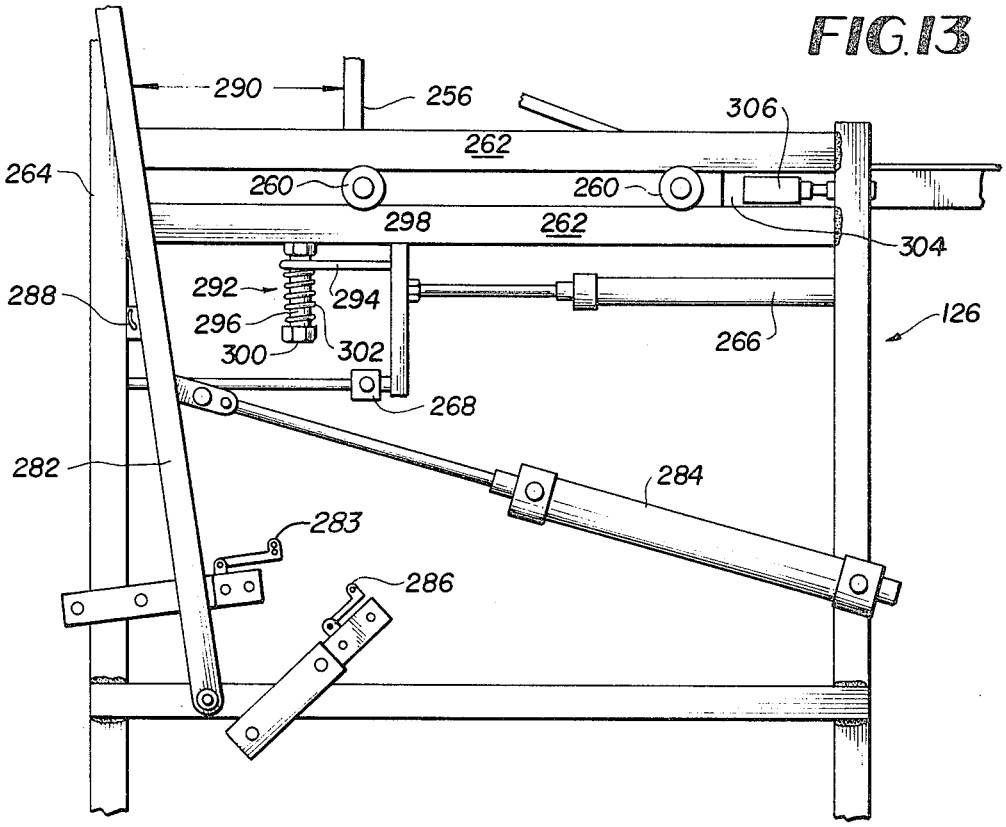
FIG. 13 is a right side elevational view of the stacker portion of the placket forming machine.
Figure 14:
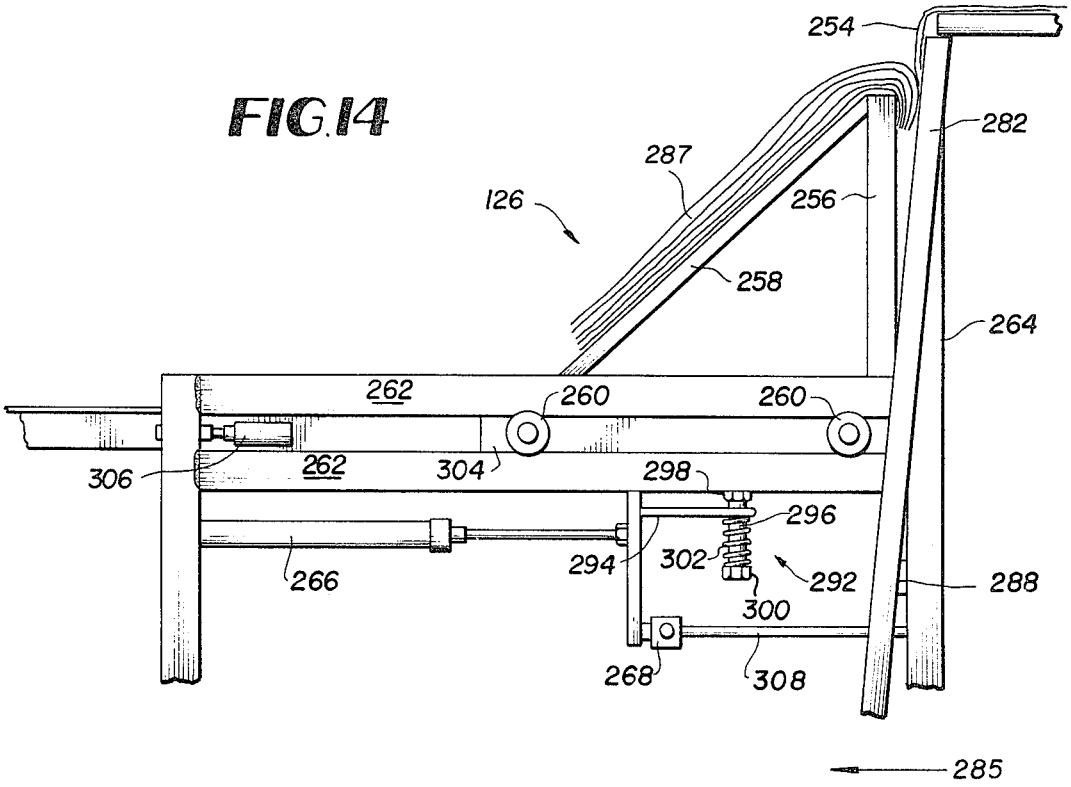
FIG. 14 is a left side elevational view of the stacker of FIG. 13.

Referring now to FIGS. 13 and 14 the operation of the stacker unit is illustrated wherein table top 258 a number of placket shirt fronts 287 are positioned on wedge shaped stacker table 258. In the rest position (FIG. 13), the wedge shaped stacking element is spaced from bracket 264 at a sufficient distance to allow a further shirt front bottom portion 254 to be received by the stacker unit 126. Switch 238 may also be employed before or after the mitre cut to activate cylinder 266 and thereby clamp bottom portion of shirt bodies 30.

Preferably the activation of cylinder 266 occurs after the mitre cut so that clamping of the shirt bottom portion 254 results in the activation of a switch 268 which results in the raising of sew clamp 74 to return the sew clamp to its starting position (FIG. 1). Switch 268 which is mounted to bracket 308 may also be conveniently employed to activate a cylinder 284 which is connected to raker bar 282 to pull sewn shirt and threads from sewing machine 98 in direction of arrow 285 (FIG. 14).

After a predetermined amount of travel the raker bar 282 actuates a switch 283 which activates cylinder 270 (FIG. 11) to drop a wedge shaped knife 272 to cut the threads pulled from the sewing machine needles 100 and 102. A mating element 274 is preferably disposed flush with table 22 and includes a slotted opening in which the sides 276 and 278 are razor sharp so when the threads from the machine needles is pressed into the slotted opening the threads are cut by wedge shaped knife 272. When raker bar 282 releases switch 283 it retracts cylinder 270 moving wedge shaped knife 272 to its start position so that when raker bar 282 reaches its full travel in the direction of arrow 285 (FIG. 14) it actuates switch 286. At this point shirt body 30 is thereby stacked on a wedge shaped table 258 over a number of layers of previous shirt fronts 287.

At the end of the travel of raker bar 282 the shirt is layered and switch 286 is contacted which returns the raker bar to its rest position. In returning to the rest position raker bar 282 contacts a futher switch 288 which results in the unclamping of the stacker unit 126 and returning the wedge shaped stacking table 258 back to its rest position.

The return of the wedge shaped table 258 to substantially the same position in the stacking operation to result in opening 290 is maintained at substantially the same distance which is achieved by an adjustable tensioning means 292 that also assists in maintaining the same amount of clamping pressure on the shirt fronts irrespective of the thickness of the layers of the shirt fronts. The adjustable tensioning means 292 may include a slotted arm 294 in which a threaded or other cylindrical peg 296 is tensionally engaged by the action of nuts 298 and 300 and the action of spring 302 which allows peg 296 to slide in slotted arm 294 when support 256 attached to platform 304 with or without layered parts 287 applies pressure on stationary bar 264. The forward travel of the slotted arm 294 terminates when cylinder 266 reaches its full extension. When slotted arm 294 reaches the end of its forward travel the lower portion of slotted arm 294 contacts switch 268 which activates sew clamp 74 to raise and also activates sew clamp 74 to return to its start position. When platform 304 contacts stops 306 platform 304 is reset to its start position.

Upon completion of the stacking of the shirt by the actuation of raker bar 282 and activation of switch 288 terminates the cycle of the stacking and clamping mechanism 126 and opens the clamp so that a futher shirt may be received. The actuation of a switch 288 may be utilized to allow the resetting of switch 54 or if already reset start the machine to again activate the transfer clamp to clamp and transfer the shirt to sew clamp and complete the cycle as heretofore described. It will be recognized by those skilled in the art that other switching arrangements are possible such as the return of the sew clamp activating the transfer clamp to restart the operation even prior to the stacking of the previous shirt.

Despite the particular arrangement of switching it will be recognized that the present apparatus and method requires the operator of the machine to only stack the shirt body, placket, and liner in there proper position and to initiate the operation of the placket sewing machine to produce a sewn, mitred, and stacked placket shirt front without futher manual operation. As a result, much of the human error, labor and skill heretofore required in the manual operation of the sewing of placket shirt fronts is eliminated by the fully automated system of the present invention.

It will be recognized that the advantages of the method of the invention which starts sewing at or near the center of the shirt and thereafter sews from the center up to the top of the shirt, allows the placket shirt fronts to be formed automatically and allows various types of sewing machines to be utilized, such as chain stitch, lock stitch and other varieties of sewing machines. Furthermore the method and apparatus of the present invention allows the formation of precisely sewn and mitred placket shirt fronts thereby improving the quality of placket shirt fronts and reducing the number of "second" quality shirts produced. Production of placket shirt fronts by the method and apparatus of the present invention is extremely rapid since the entire cycle of the machine takes about 16 hundredths of a minute to complete. Consequently about 6 shirts a minute can be produced provided the operator could keep up with the apparatus of the present invention.

The present invention is amenable to a wide range of applications even though it is particularly useful in providing for the production of an automated placket shirt front apparatus. For example the present method and apparatus may be utilized in the construction of types of garments utilizing a placket like shirt opening and for sewing various styles of garments. The invention is therefore susceptable to many mechanical modifications that could be made by those skilled in the art to utilize the present method to accomodate a variety of garments by modifications in the means for lining up and transferring the garment and modifications in the rack and pinion arrangement of the sewing machine. The application of the invention to the variety of operations to which it may be employed contemplates the modification to include a greater or lesser number of switches and the simultaneous performance or a number of functions either in direct relationship with one or more of the switches described or the elimination of certain switches.

In addition, the precise mechanical systems and their configuration described for the mitring, transferring and providing for the travel of the transfer clamp, sew clamp, mitre and stacking unit, may of course be modified to suit particular requirements.

It will also be recognized by those skilled in the art, that while the present system as has heretofore been described in the preferred embodiment employs a pneumatic or air system for driving the cylinders to perform the variously described functions. It will be understood the present invention may be implemented in a variety of ways such as the utilization of electric systems, computer-type systems of other types of switching and driving mechanisms and may utilize a timing mechanism for coordinating the relationship between the various functions in the operation of the machine.

It will be further recognized that variations the placket forming machine and stacker unit may be made to suit particular design and manufacturing requirements for various types of garments. It will further be recognized the advantages incumbent in the present invention, such as efficiency of use and the reduction of labor, increased production and quality of the finished garment may be implemented in a number of ways to suit a variety of manufacturing designs and requirements which are within the contemplation of the present invention. These and other modifications and other applications of the present invention may be made within the spirit and scope of the invention as defined in the appended claims.

What is claimed is:

1. A method of automatically sewing, removing, and stacking a garment after first hand orientating the garment in relation to a sewing machine comprising:
(a) transferring a garment to a sewing machine;
(b) initiating the sewing of said garment at a point intermediate a first end and a second end of said garment and sewing from said point to said first end of said garment;
(c) cutting the threads from said sewing machine after sewing to said first end of said garment;
(d) clamping said second end of said garment; and
(e) pulling said sewn garment from said sewing machine.

2. The method of automatically sewing, removing, and stacking a garment of claim 1 further comprising the step of cutting said garment.

3. The method of automatically sewing, removing, and stacking a garment of claim 2 wherein said step of cutting said garment occurs prior to cutting said threads from said sewing machine.

4. The method of automatically sewing, removing, and stacking a garment of claim 1 further comprising the step of stacking said sewn garment after it is pulled from said sewing machine.

5. The method of automatically sewing, removing and stacking a garment of claim 1 further comprising the step of blowing said second end past said sewing machine prior to initiating said sewing of said garment intermediate said first end and said second end.

6. A method of providing for the automatic sewing and removal of placket shirt fronts after first orientating and layering a placket shirt front, placket and liner in relation to a pair of guides comprising:
(a) clamping and transferring a layered placket shirt front, placket and liner to a sew clamp;
(b) engaging said placket shirt front, placket and liner with said sew clamp;
(c) guiding said layered placket shirt front, placket and liner engaged by said sew clamp to the sewing foot of a sewing machine;
(d) sewing said layered placket shirt front, from a point intermediate a first and second end of said layered placket shirt front and sewing from said point to one end of said layered placket shirt front to said first end; and
(e) removing the sewn placket shirt front.

7. The method of providing for the automatic sewing and removal of placket shirt fronts after first orientating and layering a placket shirt front, placket and liner in relation to a pair of guides of claim 6 further comprising the step of automatically removing said sewn placket shirt front.

8. The method of providing for the automatic sewing and removal of placket shirt fronts after first orientating and layering a placket shirt front, placket and liner in relation to a pair of guides of claim 7 wherein said step of removing said placket shirt fronts includes the step of pulling said sewn placket shirt front from said sewing machine.

9. The method of providing for the automatic sewing and removal of placket shirt fronts after first orientating and layering a placket shirt front, placket and liner in relation to a pair of guides of claim 8 wherein said step of removing said placket shirt fronts includes the step of clamping said second end of said layered placket shirt front and pulling said sewn placket shirt front from said sewing machine.

10. The method of providing for the automatic sewing and removal of placket shirt fronts after first orientating and layering a placket shirt front, placket and liner in relation to a pair of guides of claim 6 further comprising the step of stacking said sewn placket shirt front after pulling said placket shirt front from said sewing machine.

11. The method of providing for the automatic sewing and removal of placket shirt fronts after first orientating and layering a placket shirt front, placket and liner in relation to a pair of guides of claim 6 further comprising the step of slitting said layered placket shirt front, placket and liner during the step of sewing said placket shirt front.

12. The method of providing for the automatic sewing and removal of placket shirt fronts after first orientating and layering a placket shirt front, placket and liner in relation to a pair of guides of claim 6 wherein said steps of guiding and sewing said layered placket shirt front, placket and liner is accomplished by incrementally advancing said sew clamp a distance which corresponds to the length of each sewing machine stitch.

13. The method of providing for the automatic sewing and removal of placket shirt fronts after first orientating and layering a placket shirt front, placket and liner in relation to a pair of guides of claim 6 further comprising the step of blowing said second end of said layered placket shirt front, past said sewing machine foot prior to initiating said sewing.

14. The method of providing for the automatic sewing and removal of placket shirt fronts after first orientating and layering a placket shirt front, placket and liner in relation to a pair of guides of claim 6 further comprising the step of mitre cutting said placket shirt front.

15. A combination sewing machine and stacking apparatus for automating the process of sewing garments comprising in combination:
(a) means for clamping and transferring a garment from a work area to the sewing foot of a sewing machine;
(b) means to initiate the sewing of said garment at a point intermediate the ends of said garment to one of the ends of said garment;
(c) means for advancing said means for transferring and clamping said garment upon activation of said sewing machine the length of a stitch of said sewing machine;
(d) means for positioning the needles of said sewing machine out of said garment after sewing to one of said ends of said garment;
(e) means for cutting the threads to separate the garment from the needles of said sewing machine; and
(f) a stacking apparatus means for removing and stacking said garment from said sewing machine.

16. The combination sewing machine and stacking apparatus for automating the process for sewing garments of claim 15 wherein said means for clamping and transferring said garment comprises a transfer clamp and a sew clamp.

17. The combination sewing machine and stacking apparatus for automating the process for sewing garments of claim 16 wherein said transfer clamp transfers said garment to said sew clamp.

18. The combination sewing machine and stacking apparatus for automating the process for sewing garments of claim 17 wherein said sew clamp includes air jets for blowing one end of said garment past the sewing foot of said sewing machine.

19. The combination sewing machine and stacking apparatus for automating the process for sewing garments of claim 15 further comprising means for cutting said garment.

20. The combination sewing machine and stacking apparatus for automating the process for sewing garments of claim 17 wherein said means for removing and stacking said garment from said sewing machine further comprises a clamp and raker bar.

21. The combination sewing machine and stacking apparatus for automating the process for sewing garments of claim 20 wherein said means for removing and stacking said garment from said sewing machine further includes a wedge-shaped stacking table for stacking said garment.

22. The combination sewing machine and stacking apparatus for automating the process for sewing garments of claim 21 wherein said means for removing and stacking said garment from said sewing machine includes an adjustable tensioning mechanism for maintaining a substantially uniform opening of said clamp of said stacking apparatus.

23. A machine for sewing placket shirt fronts comprising in combination:

(a) means for aligning and layering a shirt front, placket and liner to form a garment;
(b) a transfer clamp for clamping and transferring a garment from one area to another;
(c) a sew clamp for receiving cloth received from said transfer clamp, said sew clamp including means for positioning said garment under a sewing machine intermediate the ends of said garment means for incrementally advancing said sew clamp in timed relationship with said sewing machine;
(d) a sewing machine;
(e) means for cutting the sewing thread after sewing; and
(f) means for removing said garment from said sewing machine.

24. The machine for sewing placket shirt fronts of claim 23 further comprising a mitre for mitring said garment.

25. The machine for sewing placket shirt fronts of claim 23 wherein said means for removing said garment includes a clamp for clamping one end of said garment and a raker bar for removing said garment from said sewing machine.

26. The machine for sewing placket shirt fronts of claim 23 wherein said means for cutting said sewing thread after sewing comprises an impact cutter having a wedge shaped tip designed to contact a slot having razor edges.

27. The machine for sewing placket shirt fronts of claim 23 wherein said means for incrementally advancing said sew clamp comprises an arm eccentrically mounted at one end to a sewing machine handwheel and mounted to a rack and pinion at the other end.

28. An automated placket shirt front sewing machine comprising in combination:

(a) a sewing machine, said sewing machine having at least one needle;
(b) a transfer clamp for transferring layered placket shirt components;
(c) a sew clamp for clamping layered placket shirt components received from said transfer clamp, said sew clamp including means for positioning said layered components under said sewing machine at a point intermediate the ends of said layered shirt components;
(d) means for incrementally advancing said sew clamp the length of each stitch of the sewing machine;
(e) means for mitre cutting said layered placket shirt components;
(f) means for cutting the sewing machine threads; and
(g) means for pulling said layered placket shirt components from the automated placket shirt front sewing machine.

29. A stacking apparatus for removing garments from garment handling machinery comprising:

(a) a frame;
(b) a garment stacking table slideably mounted with respect to said frame;
(c) a garment clamp formed by the cooperation of one side of said slideably mounted garment stacking table with said frame wherein said clamp is disposed between said stacking table and said frame; and
(d) a raker bar pivotally mounted to said frame for travel between said garment clamp and said garment stacking table.

30. The stacking apparatus for removing garments from garment handling machinery of claim 29 additionally comprising an adjustable tensioning mechanism for automatically maintaining a substantially constant opening and clamping force between said one side of said garment stacking table and said frame as said garments are layered or removed from said stacking table by the operation of said clamp as it opens and closes.

31. The stacking apparatus for removing garments from garment handling machinery of claim 30 wherein said adjustable tensioning mechanism comprises a tensioned peg in a slot in combination with a stop at the end of the travel of said slideably mounted garment stacking table which adjusts said peg in said slot as said garment clamp opens and closes in operation as the thickness of garments clamped therein incrementally increases or decreases.

32. A method for automatically sewing, removing, and stacking a garment comprising:

(a) aligning and layering parts of a garment to be sewn by employing a layering guide means;
(b) mechanically transferring said garment to a sewing machine by employing a transfer clamp;
(c) sewing said garment from a point intermediate a first end and a second end of said garment and sewing from said point to said first end of said garment; and
(d) mechanically removing said garment from said sewing machine by employing a stacking apparatus wherein said steps of transferring, sewing and removing said garment are performed in a timed mechanical sequence.

* * * * *